US008994256B2

(12) United States Patent
Below et al.

(10) Patent No.: US 8,994,256 B2
(45) Date of Patent: Mar. 31, 2015

(54) IGNITER FOR AN INTERNAL COMBUSTION ENGINE

(75) Inventors: Matthew Brian Below, Fundlay, OH (US); Jeff Boehler, Holland, OH (US); Corey Eiden, Walbridge, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/542,020

(22) Filed: Jul. 5, 2012

(65) Prior Publication Data

US 2013/0009537 A1 Jan. 10, 2013

Related U.S. Application Data

(60) Provisional application No. 61/504,852, filed on Jul. 6, 2011.

(51) Int. Cl.

| | |
|---|---|
| ***H01T 13/20*** | (2006.01) |
| ***H01T 13/39*** | (2006.01) |
| ***H01T 13/46*** | (2006.01) |

(52) U.S. Cl.

CPC ..... *H01T 13/20* (2013.01); *H01T 13/39* (2013.01); *H01T 13/467* (2013.01)

USPC ..... 313/141; 313/118

(58) Field of Classification Search

USPC ..... 313/140, 141; 445/7

See application file for complete search history.

(56) References Cited

U.S. PATENT DOCUMENTS

| | | | | |
|---|---|---|---|---|
| 4,695,758 | A * | 9/1987 | Nishida et al. | 313/130 |
| 4,841,925 | A * | 6/1989 | Ward | 123/143 B |
| 5,697,334 | A | 12/1997 | Below | |
| 8,053,965 | B2 | 11/2011 | Boehler | |
| 2008/0272683 | A1 * | 11/2008 | Boehler et al. | 313/141 |

* cited by examiner

*Primary Examiner* — Joseph L Williams

(74) *Attorney, Agent, or Firm* — Erin J. Fox; Barnes & Thornburg LLP

(57) ABSTRACT

An igniter for an internal combustion engine includes a center electrode, an insulator disposed about the center electrode, and a ground shield or a threaded portion disposed about the insulator, wherein the insulator includes a tip portion extending past an end portion of the ground shield and a tip portion of the center electrode extending through and away from the tip portion of the insulator. The igniter further includes a cap secured to the center electrode, wherein the cap extends past and covers a distal end of the tip portion of the center electrode and a distal end of the tip portion of the insulator. A spark gap is disposed between a peripheral edge of the cap and the end portion of the ground shield or threaded portion wherein the peripheral edge of the cap is spaced away from a surface of the tip portion of the insulator.

12 Claims, 3 Drawing Sheets

IGNITER FOR AN INTERNAL COMBUSTION ENGINE

CROSS-REFERENCE

This application claims the benefit of U.S. Provisional Patent Application Ser. No. 61/504,852 titled "Igniter" and filed Jul. 6, 2011, the contents of which are incorporated herein by reference in their entirety.

BACKGROUND OF THE INVENTION

Exemplary embodiments of the present invention relate to a spark plug or igniter for an internal combustion engine, and more particularly to a spark plug or igniter that initiates combustion, facilitates combustion control and burns off soot deposits in a diesel engine.

Soot is a common byproduct of the incomplete combustion of fuel in internal combustion engines namely, diesel engines. In particular, conventional fuels are comprised of hydrocarbons, which after undergoing complete combustion, produce byproducts of only carbon dioxide and water. However, complete combustion does not typically occur in internal combustion engines since no known engine is entirely efficient. In addition, complete combustion can require a lean fuel-air mixture whereas typical engine conditions require richer fuel-air mixtures to produce a desired performance.

Further emission regulations are mandating the use of new engine combustion cycles such as homogeneous charge compression ignition (HCCI) and exhaust treatment systems for diesel engines. These new combustion cycles will require new methods for combustion sensing and control. There may also be certain engine load conditions where more conventional combustion cycles still work best. For these conditions, spark assist is one means of controlling the combustion process. This unique combination of needs for in-cylinder combustion sensing and combustion initiation can be supported with a spark plug designed to work well in the higher pressure diesel engine cylinder environment as an igniter and also as an ion sensor for combustion feedback and control. For exhaust treatment, better methods are needed to actively regenerate the particulate filters. One method for active regeneration is to provide a self contained burner system to add heat energy to the exhaust to initiate the regeneration cycle. This burner system requires a reliable igniter that can survive in the corrosive and turbulent diesel exhaust environment.

In addition, soot typically accumulates at a higher rate in diesel engines than in gasoline engines due to the different ways that fuel is injected and ignited. In particular, in gasoline engines, fuel is injected during the intake stroke and thoroughly mixed with air before ignition by a spark. Conversely, in diesel engines, fuel is injected during the compression stroke and ignited spontaneously from the pressure. In that respect, combustion occurs at the boundary of unmixed fuel, where localized pockets of rich fuel-air mixtures are ignited, thus producing soot.

Soot deposits can accumulate on insulator tips of conventional spark plugs used as an igniter in a burner system. The exposed surface of the insulator tip is typically located at or near the boundary of unmixed fuel. Moreover, the exposed surface of the insulator tip is not typically located in or about the spark gap between the side electrode and the center electrode. In particular, the typical spark plug includes a center electrode extending past an insulator tip and a side electrode extending past the center electrode. For these reasons, soot may accumulate on the insulator tip and may not be burned off.

Accordingly, it is desirable to provide a spark plug or igniter design that is more robust than conventional spark plug designs to high cylinder pressures and to the corrosive effects of the combustion chamber or exhaust.

SUMMARY OF THE INVENTION

In accordance with a non-limiting exemplary embodiment of the present invention, an igniter for an internal combustion engine includes a center electrode, an insulator disposed about the center electrode, and a ground shield disposed about the insulator, wherein the insulator includes a tip portion extending past an end portion of the ground shield and a tip portion of the center electrode extending through and away from the tip portion of the insulator. The igniter further includes a cap secured to the center electrode, wherein the cap extends past and covers a distal end of the tip portion of the center electrode and a distal end of the tip portion of the insulator. A spark gap is disposed between a peripheral edge of the cap and the end portion of the ground shield or threaded portion wherein the peripheral edge of the cap is spaced away from a surface of the tip portion of the insulator.

In accordance with another non-limited exemplary embodiment of the present invention, an igniter for an internal combustion engine includes a center electrode and an insulator disposed about the center electrode. The igniter further includes a threaded portion disposed about the insulator, the insulator having a tip portion extending past an end portion of the threaded portion and a tip portion of the center electrode extending through and away from the tip portion of the insulator. A cap is secured to the center electrode, wherein the cap extends past and covers a distal end of the tip portion of the center electrode and a distal end of the tip portion of the insulator. A spark gap is disposed between a peripheral edge of the cap and the end portion of the threaded portion, wherein the peripheral edge of the cap is spaced away from a surface of the tip portion of the insulator.

DETAILED DESCRIPTION OF EXEMPLARY EMBODIMENTS

Exemplary embodiments of the present invention relate to an igniter or igniter/ion sensor for high compression engines and in particular, an igniter for use in a burner system for regenerating a filter (e.g., diesel particulate filter "DPF" or other equivalent filter requiring high temperature regeneration using an igniter). Exemplary embodiments of the present invention are related to U.S. Pat. No. 5,697,334, the contents of which are incorporated herein by reference thereto.

In accordance with an exemplary embodiment and as illustrated in the attached drawings, a "high thread" spark plug is provided with a circular side electrode shape that allows for the spark energy to pass over the ceramic insulator tip surface, thereby creating the igniter of exemplary embodiments of the present invention. In a non-limiting exemplary embodiment, the side electrode is made of a high nickel or stainless steel alloy having an 8 millimeter (mm) or a 10 mm diameter or any range therebetween as well as diameter greater or less than 8 and 10 mm. Although, the dimensions greater or less than the aforementioned diameters are considered to be within the scope of exemplary embodiments of the present invention. In addition and in accordance with non-limiting exemplary embodiments of the present invention, the distance between the tip of the center electrode and the side electrode has been in the range of 2 mm to 10 mm. Furthermore, the diameter of the center electrode tip may be increased by attaching a metal disk to improve ion sensing capability of the center electrode.

In accordance with one exemplary embodiment, the spark plug must be able to produce a sufficiently high energy spark over the non-conductive ceramic insulator tip to burn off the soot formed on the insulator tip. In accordance with another exemplary embodiment, the device described herein uses a center electrode with an ion sensing portion or annular disc portion to emit a spark along the insulator tip and to detect an ion current in a combustion cylinder into which the igniter is disposed.

Figure 1A:
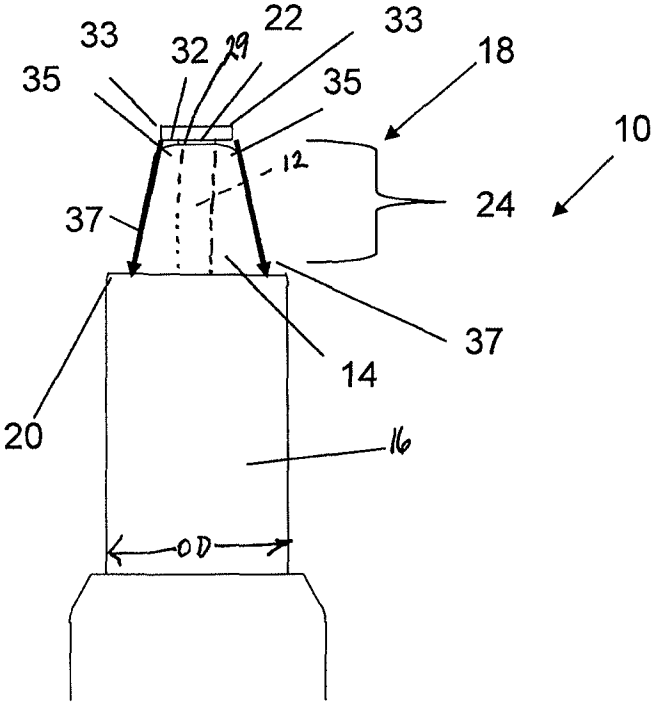
FIG. 1A is an enlarged view of the igniter of FIG. 1.
Figure 1:
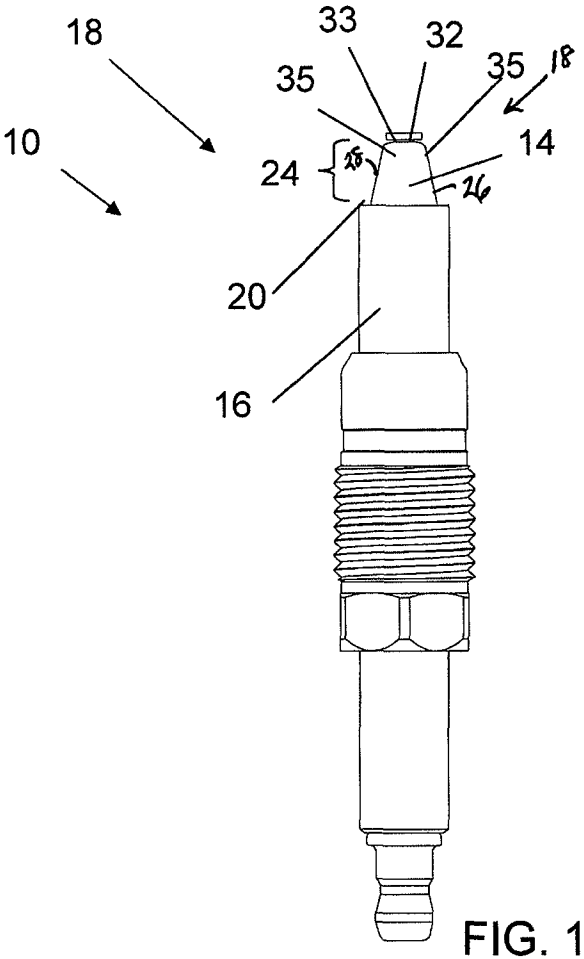
FIG. 1 is a view of an igniter.

Referring to FIGS. 1-1A, there is shown an igniter or igniter/ion sensor 10 for a high compression engine. The igniter or igniter/ion sensor or spark plug 10 includes a center electrode 12 (FIG. 1A) disposed in a center bore of an insulator 14. A ground shield 16 is disposed about the insulator 14. In accordance with an exemplary embodiment of the present invention, a tip portion 18 of the insulator 14 extends past an end portion 20 of the ground shield 16. A tip portion 22 of the center electrode 12 extends past the end of the insulator 14.

Accordingly and as illustrated, a spark gap 24 extends from the tip portion 22 of the center electrode 12 to the ground shield 16. The spark gap 24 also extends along a surface 26 of the tip portion 18 of the insulator 14. In order to "burn off" or remove soot accumulated on the surface 26, a high voltage is passed through the center electrode 12 to heat up the surface and burn away accumulated soot.

The spark gap 24 has a frustoconical shape defined by the tip portion 18 of the insulator 14, wherein an outer periphery 28 of the tip portion 18 diverges between an inner end 29 of the tip portion 22 of the center electrode 12 and the end portion 20 of the ground shield 16.

The ground shield 16 has an outer diameter OD that is between about 8 millimeters and about 10 millimeters. It is understood that the outer diameter OD can instead be more or less than this range. One non-limiting material for the ground shield 16 is a nickel alloy. However, it is contemplated that the ground shield 16 can instead be formed from stainless steel or various other suitable materials, as desired.

As depicted in FIGS. 1 and 1A, the center electrode 12 also includes a ring portion 32, which surrounds the tip portion 22 of the center electrode 12. As illustrated, the ring portion 32 is an annular disc portion that extends from the center electrode 12 and has a width greater than a width of the center electrode 12. Of course, other configurations of the ring portion 32 are considered to be with the scope of exemplary embodiments of the present invention. When the ring portion 32 (e.g., disc portion or other configuration) is disposed on the center electrode 12, the spark gap 24 extends between an outer periphery 33 of the annular disc portion 32 and the end portion 20 of the ground shield 16.

The ring portion 32 is also used as an ion sensing portion 33 as described in U.S. Pat. No. 8,053,965, the contents of which are incorporated herein by reference in their entirety. The ion sensing portion 33 is used to provide an ion sensing means as part of the igniter. In one embodiment, the annular disc portion is made from a nickel alloy and the ion sensing means is contemplated for use with a combustion control system ("system") as exemplified in U.S. Pat. No. 8,053,965.

As illustrated in FIGS. 1-1A the arc of the spark travels around the corner 35 of the ceramic insulator 14 as depicted by arrows 37. As the arc goes around the corner 35, it may form a groove in the ceramic insulator 14. If a formed groove becomes large enough, it may prevent ignition of the fuel or cause the ceramic insulator 14 to fail due to mechanical weakness.

Figures 2, 2A, 2B:
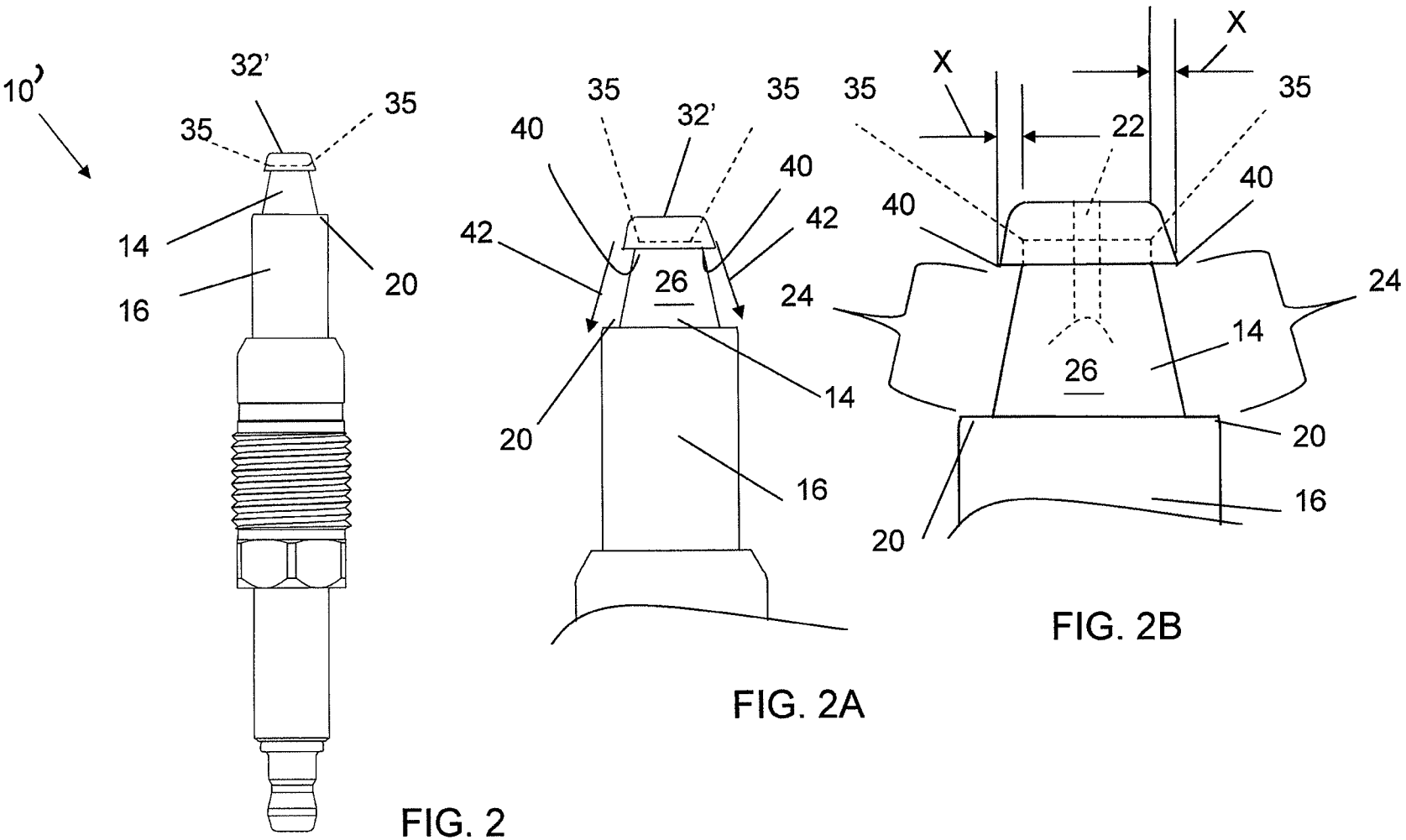
FIG. 2 is a view of an igniter constructed in accordance with a first exemplary embodiment of the present invention.
FIG. 2A is an enlarged view of the igniter illustrated in FIG. 2.
FIG. 2B is an enlarged view of the igniter illustrated in FIG. 2.

Referring now to FIGS. 2-2B a high thread spark plug 10' in accordance with an exemplary embodiment of the present invention is illustrated, wherein the design of the high thread spark plug 10' minimizes formation of a groove or "channeling" in the ceramic insulator 14. The ring 32 of the embodiment of FIGS. 2-2B is configured to have a cap, cup or inverted cup design 32', wherein a rim portion or peripheral edge 40 of the cup extends past the ceramic tip and towards the end 20 of the ground shield 16 such that the cap or cup covers the corner 35 of the end of the insulator 14.

In this configuration, the spark gap 24 will extend from a peripheral edge or rim portion 40 of the cap 32' to the end 20 of the ground shield 16, as illustrated by arrows 42. As shown, the arrows 42 are spaced from the surface 26 of the insulator 14. This spacing will eliminate the channeling at the ceramic corner and increase the surface for the spark surface.

As shown at least in FIG. 2B the peripheral edge 40 of the cap 32' is spaced at least a distance X from the surface 26 of the insulator 14 extending past the ground shield 16. This design guides the spark arc away from the surface of the ceramic insulator 14, thereby reducing damage and wear on the ceramic insulator 14.

Figure 3:
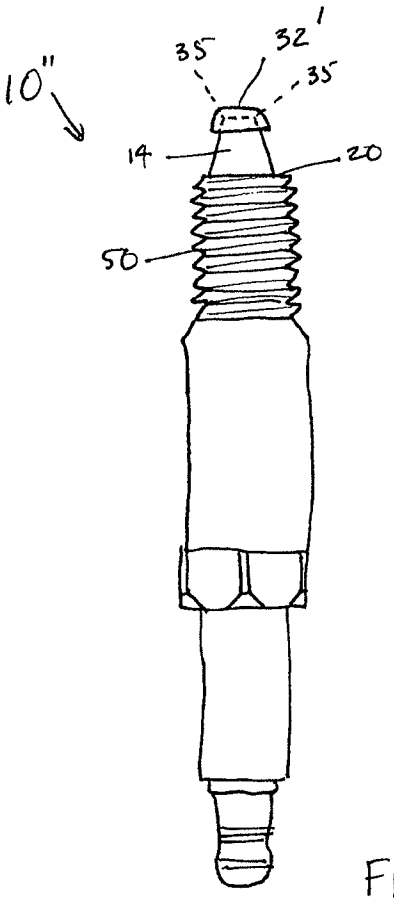
FIG. 3 is a view of a further igniter constructed in accordance with a second exemplary embodiment of the present invention.

The embodiment of FIG. 3 is identical to the embodiments of FIGS. 1-1A and 2-2B, respectively, except that igniter 10" of FIG. 3 is a conventional igniter. In particular, threaded portion 50 for attachment to a conventional engine block is disposed adjacent the insulator 14. In this manner, the igniter 10" of FIG. 3 would function in the same manner as the embodiments of FIGS. 1-1A and FIGS. 2-2B, respectively, and a spark gap 24 would be created between the ring portion 32 or the cap 32', respectively, and the end 20' of the threaded portion 50. The threaded portion 50 acts as a ground electrode and is preferably made of steel, a nickel alloy, a stainless steel alloy, or any other material known in the art.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the present application.

What is claimed is:

1. An igniter for an internal combustion engine, the igniter comprising:

a center electrode;

an insulator disposed about the center electrode;

a ground shield disposed about the insulator, the insulator having a tip portion extending past an end portion of the ground shield and a tip portion of the center electrode extending through and away from the tip portion of the insulator;

a cap secured to the center electrode, wherein the cap includes (a) a first wall that includes a first outer surface and which extends radially past a distal end of the tip portion of the center electrode; and (b) a second wall that includes a second outer surface, the entirety of which extends from and is disposed at an angle with respect to the first outer surface of the first wall, wherein the second wall extends axially past and covers the distal end of the tip portion of the center electrode and a distal end of the tip portion of the insulator, and wherein the second surface and the second wall form a peripheral edge that forms a continuous annular rim; and a spark gap disposed between the peripheral edge of the cap and the end portion of the ground shield, wherein the peripheral edge of the cap is spaced away from a surface of the tip portion of the insulator.

2. The igniter as in claim 1, wherein the spark gap has a frustoconical shape diverging from the peripheral edge of the cap to the end portion of the ground shield.

3. The igniter as in claim 2, wherein the ground shield is formed from one of a nickel alloy, and a stainless steel alloy.

4. The igniter as in claim 3, wherein the ground shield has an outer diameter substantially in the range between 6 millimeters and 10 millimeters.

5. The igniter as in claim 4, wherein the ground shield has an outer diameter substantially in the range between 8 millimeters and 10 millimeters.

6. The igniter of claim 2, wherein the spark gap is formed between the peripheral edge of the cap and an outer edge of the end portion of the ground shield.

7. The igniter as in claim 1, wherein the ground shield has an outer diameter substantially in the range between 8 millimeters and 10 millimeters.

8. The igniter as in claim 1, wherein the ground shield has an outer diameter substantially in the range between 6 millimeters and 10 millimeters.

9. The igniter of claim 1, wherein the end portion of the ground shield that forms the spark gap with the peripheral edge of the cap is threaded.

10. An igniter for an internal combustion engine, the igniter comprising:

a center electrode;

an insulator disposed about the center electrode;

a threaded portion disposed about the insulator, the insulator having a tip portion extending past an end portion of the threaded portion and a tip portion of the center electrode extending through and away from the tip portion of the insulator;

a cap secured to the center electrode, wherein the cap includes (a) a first portion that extends outwardly from the center electrode; and (b) a second portion that forms a frustoconical wall that extends at an angle from the first portion toward the threaded portion, wherein the second portion covers a distal end of the tip portion of the insulator, and wherein the frustoconical wall includes a peripheral edge that forms a continuous rim; and a spark gap disposed between the peripheral edge of the cap and the end portion of the threaded portion, wherein the spark gap has a frustoconical shape diverging from the peripheral edge of the cap to the end portion of the threaded position.

11. The igniter as in claim 10, wherein the threaded portion is formed from one of steel, a nickel alloy, and a stainless steel alloy.

12. An igniter for an internal combustion engine, the igniter comprising:

a center electrode;

an insulator disposed about the center electrode;

a ground shield disposed about the insulator, the insulator having a tip portion extending past an end portion of the ground shield and a tip portion of the center electrode extending through and away from the tip portion of the insulator;

a cap extending from the center electrode, wherein the cap includes (a) a radial portion that extends radially away from the center electrode; and (b) an axial portion that forms a frustoconical wall that extends at an angle away from the radial portion toward the ground shield, wherein the axial portion extends axially beyond a distal end of the tip portion of the insulator along a direction that is parallel to an axis of the igniter, and wherein the frustoconical wall includes a peripheral edge that forms a continuous rim; and a spark gap disposed between the peripheral edge of the cap and the end portion of the ground shield, wherein the spark gap has a frustoconical shape diverging from the peripheral edge of the cap to the end portion of the ground shield.

* * * * *